US005227807A

United States Patent [19]

Bohlman et al.

[11] Patent Number: 5,227,807

[45] Date of Patent: Jul. 13, 1993

[54] DUAL POLARIZED AMBIDEXTROUS MULTIPLE DEFORMED APERTURE SPIRAL ANTENNAS

[75] Inventors: Walter A. Bohlman, Line Lexington; James M. Schuchardt, Gwynedd Valley, both of Pa.

[73] Assignee: AEL Defense Corp., Lansdale, Pa.

[21] Appl. No.: 443,540

[22] Filed: Nov. 29, 1989

[51] Int. Cl.[5] ..... H01Q 1/360; H01Q 11/080

[52] U.S. Cl. ..... 343/895

[58] Field of Search ..... 343/895, 867, 868, 792.5; 342/445, 447

[56] References Cited

U.S. PATENT DOCUMENTS

| | | | |
|---|---|---|---|
| 2,953,781 | 9/1960 | Donnellan et al. | 343/895 |
| 2,977,594 | 3/1961 | Marston et al. | 343/895 |
| 3,017,633 | 1/1962 | Marston et al. | 343/895 |
| 3,229,293 | 1/1966 | Little et al. | 342/447 |
| 3,246,331 | 4/1966 | Royal | 342/447 |
| 3,374,483 | 3/1968 | Fenwick | 343/895 |
| 3,454,951 | 7/1969 | Patterson et al. | 343/895 |
| 3,530,486 | 9/1970 | Strider | 343/895 |
| 3,683,385 | 8/1972 | Corzine et al. | 343/895 |
| 4,277,788 | 7/1981 | Törby | 342/432 |
| 4,319,248 | 3/1982 | Flam | 343/701 |
| 4,559,539 | 12/1985 | Markowitz et al. | 343/725 |
| 4,658,262 | 4/1987 | DuHamel | 343/895 |

FOREIGN PATENT DOCUMENTS

| | | | |
|---|---|---|---|
| 2363618 | 7/1975 | Fed. Rep. of Germany | 343/895 |
| 2707819 | 9/1977 | Fed. Rep. of Germany | 343/895 |

OTHER PUBLICATIONS

Kaiser, Scanning Arrays Using the Flat Spiral Antenna Doc. #PB130193 Research Reports, vol. 29, No. 5, pp. 2574 May 1958.

Phelan, L-Band Spiraphase Array Microwave Journal Jan. 1977, pp. 47-50.

Nakano, H. et al., Sunflower Spiral Antenna, Conf: 1980 Int. Symp. Digest on Antennas and Prop., Quebec, Canada Jun. 2-6 1980 pp. 709-711.

*Primary Examiner*—Rolf Hille

*Assistant Examiner*—Peter Toby Brown

*Attorney, Agent, or Firm*—Seidel, Gonda, Lavorgna & Monaco

[57] ABSTRACT

An antenna group comprising a plurality of spiral antennas occupies a circular space. The spiral antennas are radially symmetrically arranged about a point at the center of the circle. Each spiral antenna is deformed to occupy a substantially all of the area within a sector of the circle. The antenna may be used for detection of circularly-polarized waves of either polarization sense, or may operate with phase-sensing means to locate the source of incoming electromagnetic radiation.

17 Claims, 10 Drawing Sheets

FIG. 9a
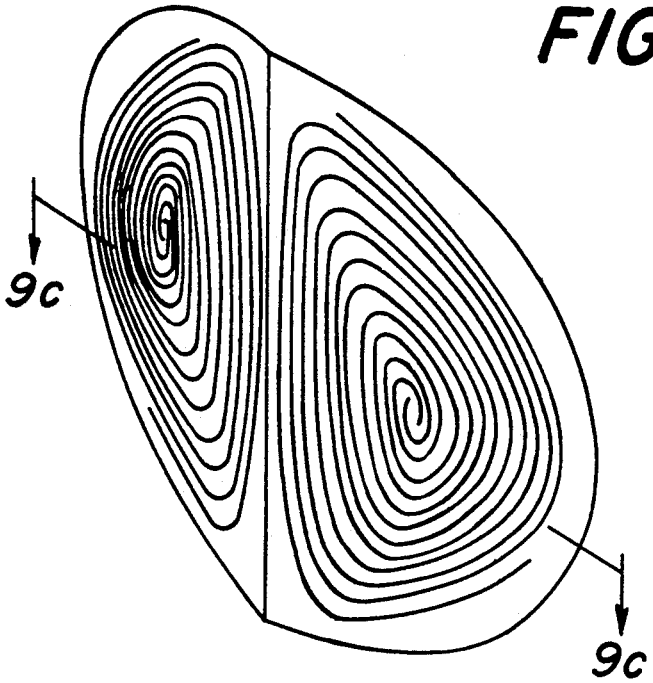
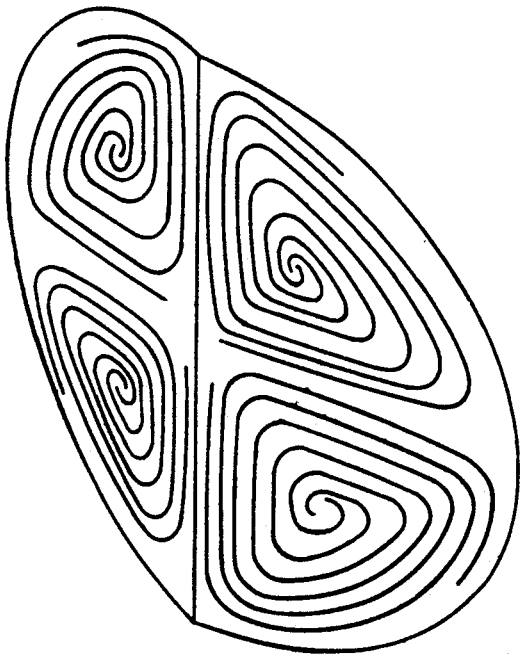
FIG. 9b
FIG. 9c
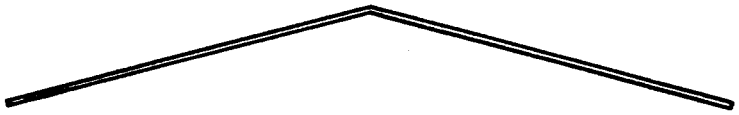

DUAL POLARIZED AMBIDEXTROUS MULTIPLE DEFORMED APERTURE SPIRAL ANTENNAS

FIELD OF THE INVENTION

The present invention relates to spiral antennas, particularly, but not necessarily, those which are installed in missiles or aircraft.

BACKGROUND OF THE INVENTION

Spiral antennas are known for obtaining a wide bandwidth in transmitting or receiving electromagnetic radiation. See, for example, U.S. Pat. No. 2,977,594. A spiral antenna generally comprises two conductors, spaced from each other and interwound in a planar spiral. A spiral antenna may be energized at its center by means of a cable with one conductor of the cable connected to one conductor of the spiral and another conductor of the cable connected to the second conductor of the spiral. A spiral antenna has an operating bandwidth determined by the circumference of the conductors which form the spiral. Generally, each curved section within the spiral corresponds to a different wavelength within the bandwidth. A section of the spiral becomes activated where currents in the two conductors at a given frequency are substantially in-phase. The lower frequency limit of the antenna is determined by the outermost or largest diameter of the spiral, and the upper frequency limit is determined by the diameter of the spiral where the conductors are at their smallest dimension that still contains a spiral curvature at the center of the antenna. Thus, a spiral antenna may transmit or receive a broad bandwidth of frequencies within these two geometrically determined limits.

When such a spiral antenna is energized by radio frequency energy, it radiates a broad, circularly polarized unidirectional beam from each side of the plane of the spiral. Each radiated beam is normal to the plane of the spiral.

With spiral antennas, it must be remembered that the direction (clockwise or counter clockwise) of the spiral depends on which direction the spiral is being viewed from. The term "configuration sense" is used to indicate the direction of rotation as one proceeds outward from the center of the spiral as viewed from one side. Thus a single antenna element actually has two configuration senses depending on which side is viewed. When a spiral antenna is energized, the polarization of the beam on any one side corresponds to the configuration sense of the spiral as viewed from the opposite side. Accordingly, the two radiated beams are identical except that the polarization of the radiated field on one side is the opposite of that on the other.

Generally, in the art of antennas, a transmitted beam is characterized as polarized either horizontally or vertically with respect to the ground. With conventional straight-wire antennas, a receiving antenna can receive a signal from a transmitting antenna only to the extent the two antennas share the same horizontal or vertical polarization. For example, theoretically, a wire antenna perfectly perpendicular to the ground would not be able to receive a signal from a transmitting antenna which was parallel to the ground. An analogous principle applies to spiral antennas. With a spiral antenna, a transmitted beam has a property of either left or right hand circular polarization. A right-hand-polarized side of a spiral antenna can receive signals only from a right-hand-polarized side of a transmitting antenna. In most real-world situations, it is necessary for an antenna on board a missile or aircraft to receive a signal regardless of circular polarization. One way of receiving signals of either polarization is to employ two spiral antennas, with opposite configuration senses. See, for example, U.S. Pat. No. 2,977,594, FIG. 2. With two antennas, the portion of a signal that cannot be received by one antenna will be received by the other antenna. It is therefore desirable to provide a geometric arrangement of spiral antennas having different configuration senses, and therefore able to receive signals regardless of circular polarization, which occupies the space normally occupied by a single spiral antenna.

A problem with known spiral antenna geometries is that it is difficult to employ multiple antennas to form a broadband antenna system and still fit within the space normally occupied by one of the antennas alone. For example, radar warning receivers in missiles and aircraft generally utilize a spiral antenna housed in a space provided in the frame of the aircraft. Known antenna systems covering the required bandwidth for this situation generally comprise multiple spiral antennas which will not fit in the space provided for an existing single spiral antenna. To install a multiple spiral antenna system, it is necessary either to modify the frame of the aircraft by increasing the amount of space provided for a single antenna or to deform the geometric pattern of each antenna to fit the available space. Modification to the aircraft frame is undesirable because it is costly and time consuming. U.S. Pat. No. 4,559,539, assigned to the assignee of the present invention, is one example of a group of spiral antennas within a circular housing. The antenna disclosed in that patent, however, is not a dual polarization configuration sense antenna but, rather, a group of single polarization configuration sense antennas with different bandwidths.

The present invention provides a novel, non-obvious, solution to the problem of fitting a plurality of spiral antennas having different configuration senses into the space of a single spiral.

SUMMARY OF THE INVENTION

The present invention is a spiral antenna disposed within a sector of a circular area, the area of the sector being not more than one half of the circular area. The spiral antenna geometry is deformed to conform to the shape of the sector. In this way, a number of spiral antennas may be disposed in various sectors of a single circular area, forming a multiple antenna geometry.

One embodiment of the invention is an antenna geometry in which a plurality of spiral antennas are arranged in a circular area in this manner. Different spiral antennas in the group may have opposite configuration senses, so that the group may be sensitive to circularly-polarized signals of either configuration sense. Another embodiment of the invention is an antenna group of two spiral antennas where the circumferential length of the outermost arm of each spiral is not less than 0.75 times the circumference of an imaginary circle circumscribed around the two antennas.

In a preferred embodiment of the invention, a group comprising two spiral antennas having opposite configuration senses, each having a semicircular shape, is mounted on a plate having a circular cross-section, such as would be found in a cross-section of an aircraft or missile. Each antenna is disposed within and deformed to fit one of two semicircular areas separated by a diameter of the circular cross-section. Typically, spiral antennas cannot be deformed sufficiently to fill completely a semicircular area and still work properly, and unfilled spaces at diametrically opposite sides of the cavity remain, which may be used for additional antennas or other devices within the cavity.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIGS. 9 *a-c* illustrate embodiments and views of antenna groups according to the present invention with at least one antenna of the group being in a plane different from the other antennas in the group.

DETAILED DESCRIPTION OF THE INVENTION

Figure 1:
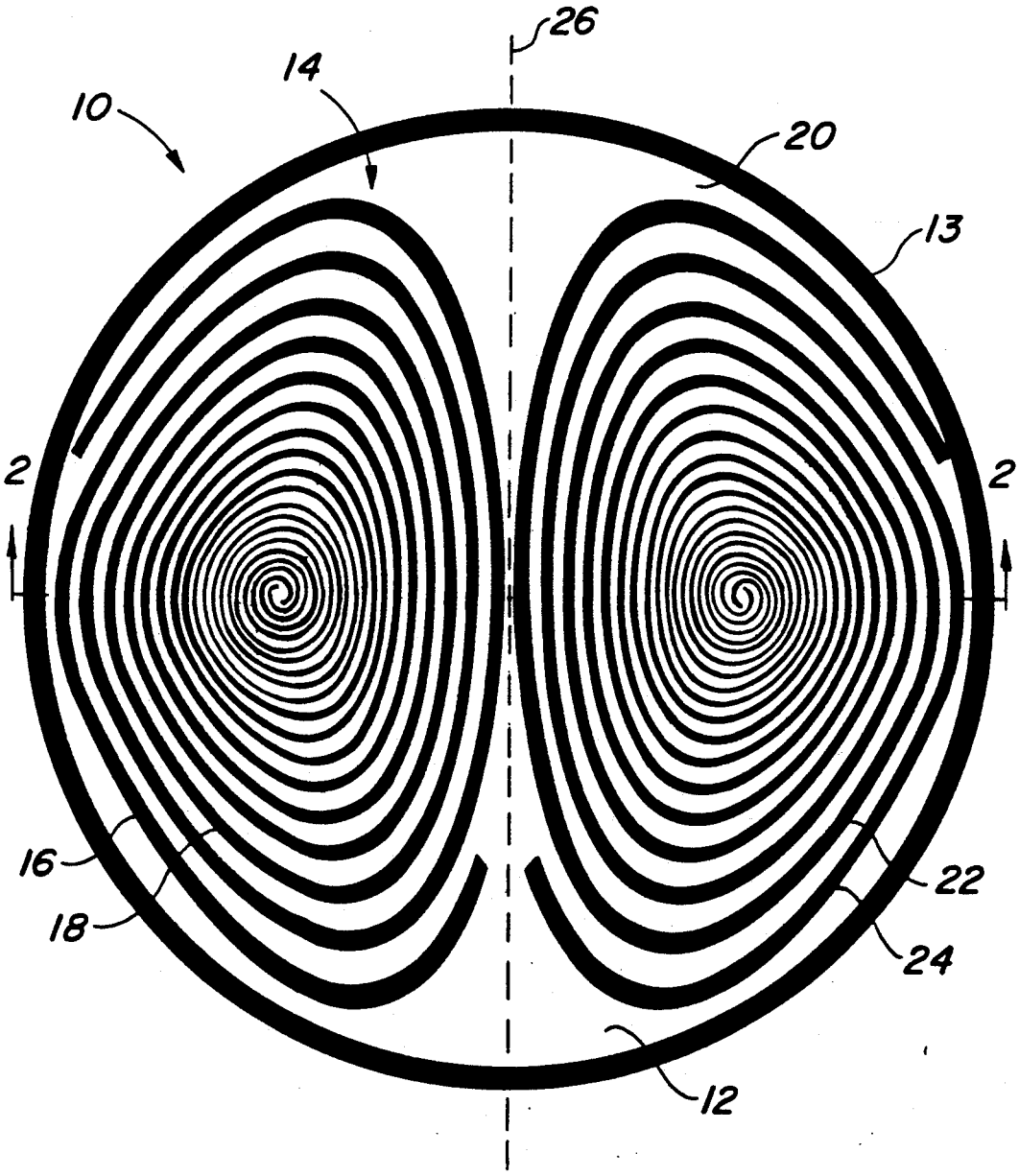
FIG. 1 is a plan view of a spiral antenna group according to one embodiment of the present invention, in which the spirals have an Archimedean-logarithmic base.

Referring now to the drawings, wherein like numerals represent like elements, there is shown in FIG. 1 an antenna system 10 according to the present invention. The antenna system 10 generally comprises an antenna support surface 12 (shown more clearly in the side view of FIG. 2) as would be found, for example, in a section of an aircraft or missile. The cross-section of surface 12 may be divided into two halves by an imaginary line, such as diameter 26, to define semicircular areas on surface 12. Disposed on surface 12 are two spiral antennas 14 and 20, each being located within one of the semicircular areas on surface 12. First spiral antenna 14 comprises two conductors, or windings, 16 and 18. Conductors 16 and 18 are arranged in a spaced, interleaved configuration and form a spiral arrangement substantially occupying the semicircular area of surface 12 in which it is located. Similarly, antenna 20, comprising two conductors, or windings, 22 and 24, occupies the other semicircular area of surface 12.

An important feature of this embodiment of the invention is that antennas 14 and 20 have opposite polarization configuration senses. That is, when viewed from either side, the spiral of one antenna is wound in a clockwise sense and the spiral of the other is wound in a counterclockwise sense. As explained above, this arrangement enables the antenna group 10 to respond to or transmit signals regardless of the circular polarization sense of the signal.

As noted, each spiral antenna 14 and 20 comprises two conductors, or windings, which are arranged in a spaced, interleaved manner and wound to form spirals. However, the shape of the spirals is deformed so that each spiral antenna 14 and 20 can fit within one of the semicircular areas of surface 12 and still comprehend a maximum proportion of each semicircular area while maintaining its pair of windings 16 and 18 or 22 and 24 in a spaced, interleaved spiral.

Figure 2:
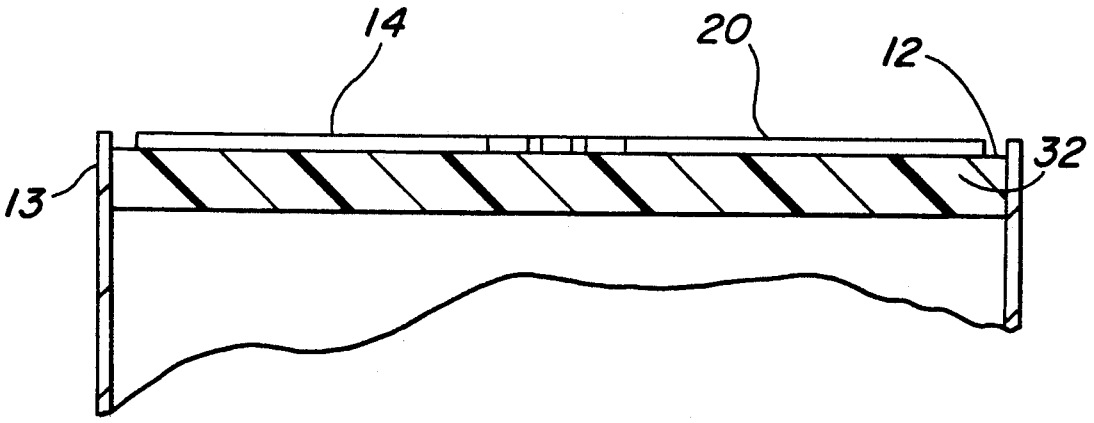
FIG. 2 is a sectional view taken along line 2—2 of FIG. 1.

FIG. 2 is a side view through line 2-2 of the antenna group of the present invention mounted inside a shallow cylindrical cavity, as would typically be found in an aircraft or missile antenna installation. The windings 16, 18, 22 and 24 are provided on the surface 12 of a dielectric support plate 32, made of a dielectric material, which may occupy a cross-section of a hollow cylindrical member, such as that shown by housing 13, as would be found in a missile or aircraft fuselage. However, any dielectric support plate may be used and the invention is not limited to cylindrical cavities, uniplanar support plates, or to aircraft or missile antennas.

The two spiral antennas 14 and 20 are shown in FIG. 1 as being arranged as Archimedean-logarithmic spirals As is well known, an Archimedian spiral is defined by the formula $r=r_o+a\theta$, where r is the radius of the spiral at a given point at angle $\theta$, $r_o$ is the radius of the spiral at the innermost point of the spiral, and a is a constant. In a logarithmic spiral, these values are related by the formula $r=r_o e a\theta$. It has been found that a compound spiral, based on an Archimedean spiral at its center and a logarithmic spiral at its periphery, results in a geometry that has a shorter transmission line length, and therefore lower transmission line losses, resulting in improved low frequency gain of the spiral. Although the compound spiral is preferred, spirals based on either Archimedean or logarithmic geometry, within the constraints of having each spiral conform to the shape of the sector, are possible.

The spiral windings 16, 18, 22 and 24 may be provided on the surface 12 of the plate 32 by the well-known technique of plating a thin conductive metal film on the surface 12 of dielectric plate 32 and removing portions of the conductive film by etching to form the windings. However, all other techniques for forming the windings are included within the scope of the invention.

Figure 10:
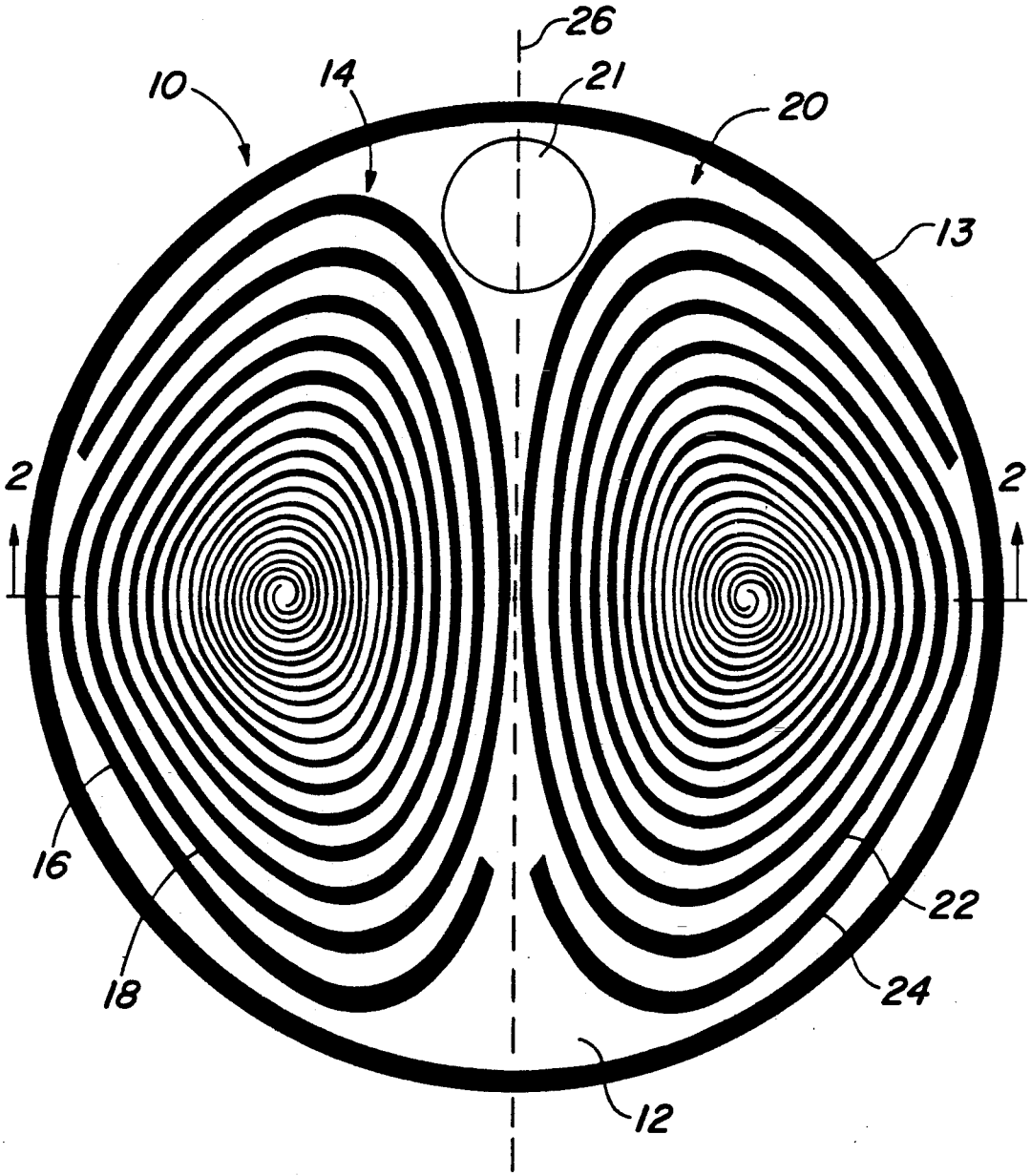
FIG. 10 illustrates an alternate embodiment of the invention, in which a third antenna is disposed on the same support as an antenna group comprising two spiral antennas.

As a practical matter, there is a limit to how much of each semicircular area the spiral can occupy while still maintaining satisfactory spacing between the two conductors of each spiral. In order to maintain proper spacing between conductors, it will sometimes result that the corners of each semicircle at either end of diameter 26 may not be encompassed by either antenna. The space 21 left open by this arrangement can be occupied by devices such as antennas, millimeter wave or IR sensors, or the like, as illustrated in FIG. 10. With this arrangement a variety of devices may be located in the space generally reserved for a single spiral antenna.

As mentioned above, a spiral antenna is responsive to a broad bandwidth because each winding of the spiral antenna essentially corresponds to a wavelength equal to that of the circumference of the winding. Thus, the lowest possible frequency that can be detected by a spiral antenna would have a wavelength equal to that of the circumferential length of the outermost arm of the spiral. (Throughout the present specification and claims, the term "outermost arm" used in relation to a spiral antenna will mean the length of one winding from the outermost end of the winding inward to the point where the winding first intersects a radius extending from the outer end of the winding to the center of the spiral. Thus, the "circumferential length" of the outermost arm, which is equal to the "perimeter" of the spiral, is the length of conductor from the outer end of the conductor to the point where the conductor first intersects a radius from the outer end of the conductor to the center of the spiral, regardless of the specific shape formed by the outermost arm of the spiral.)

In addition to the length of the outermost arm of the spiral, the dielectric constant of the spiral support 12 also affects the maximum wavelength that may be detected by an individual spiral. The dielectric support 12 provides a loading effect that can allow operation to lower frequencies than if the spiral were surrounded by air alone. The dielectric loading effect is known and is described by a modified equation for conventional transverse electromagnetic (TEM) waves:

$$\lambda_{eff} = \frac{\lambda_0}{\sqrt{\epsilon_{eff}}}$$

where $\lambda_o$ is the maximum wavelength of the antenna in air, and $\lambda_{eff}$ the effective maximum wavelength for the same antenna supported on the dielectric support 12. The value $\epsilon_{eff}$ is the effective dielectric constant, which will have a value between 1 (the dielectric constant of air) and the dielectric constant of the dielectric support 12. Because $\epsilon_{eff}$ is generally greater than 1, $\lambda_{eff}$ is decreased relative to $\lambda_o$ according to the above equation. Thus, when the antenna is supported on a dielectric support 12, in practiced, the lowest frequency that may be detected or transmitted by an individual spiral will actually be slightly lower due to the dielectric loading effects.

For a conventional spiral antenna, the longest wavelength that can be detected would have a length of $\pi$d, where d is the diameter of the spiral. With the arrangement of the present invention, the theoretical maximum wavelength that can be detected by either antenna (and, therefore, by the antenna group as a whole) is a wavelength equal to the length of the perimeter of the cross-section of each semicircular area. The perimeter of each semicircle, half the circumference of the whole circle plus the diameter of the circle, is equal to 0.8183 times the circumference of the whole circle. Thus, the theoretical maximum wavelength that can be detected by the antenna group of the present invention using conventional dielectric substrates is 0.8183 that of a single spiral antenna occupying the same space on surface 12.

In contrast, if the deformed spirals 14 and 20 were replaced with circular spirals, each having a diameter one-half that of the surface 12, each spiral would have a circumference, and therefore a maximum wavelength, of one-half $\pi$d, and the maximum wavelength that could be detected would be only 0.50 that of a single spiral Therefore, without the deformed spiral of the present invention, the bandwidth of a dual-polarized antenna group in the same space would be reduced by an entire octave. The antenna of the invention therefore offers superior performance without requiring additional space.

The geometry of the antenna group of the present invention may be employed in any situation where multiple antennas, or apertures, are required, in addition to the use described above. The various apertures on a single circular support may function in combination or independently. The spirals may, but need not, have different configuration senses. Various other uses of the deformed spirals of the present invention are described below.

When the group is illuminated by a signal in the form of an electromagnetic wave having a circular polarization, the output from one of the apertures in a pair of apertures will be high and the other near zero. This condition can be used to determine the circular polarization sense of the incoming wave. Similarly, when the group is illuminated by a signal having an elliptical polarization, both the amplitude difference and phase difference can be used to determine the polarization state; that is, the orientation of the polarization ellipse of the transmitting antenna relative to that of the receiving antenna.

When an antenna group of the present invention, for example a two-aperture group, is illuminated by a linearly polarized wave, the two apertures will respond with nearly equal amplitude. The two output voltages can then be phase compared. The phase difference varies with the orientation of the linearly polarized vector relative to the orientation of the two apertures. Thus, the incoming wave linear polarization state can be uniquely determined. When a linearly polarized wave is processed in this way by the antenna group, the group is said to be in its "polarimeter mode".

Figure 3:
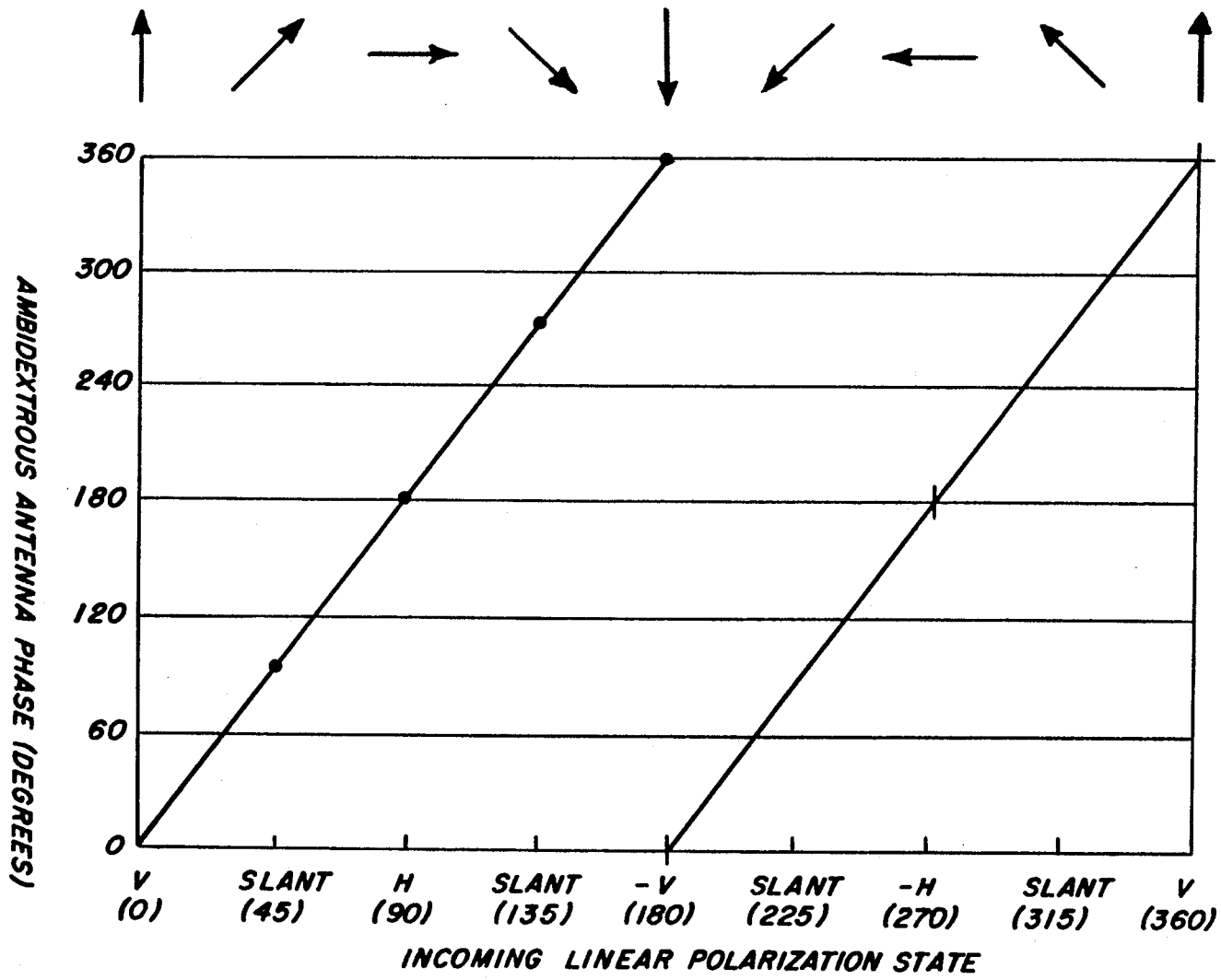
FIG. 3 is a graph showing the relationship between the linear polarization state of a wave illuminating a two-aperture antenna, and the phase difference of the signals detected by each of the spiral apertures.

FIG. 3 is a graph showing the relationship between the polarization state of an incoming wave as it illuminates a two-aperture ambidextrous antenna and the phase difference between the output signals from each of the two antennas The arrows at the top of the graph represent the linear polarization state of the incoming wave relative to the orientation of the two antennas, as though the surface of the page were the surface of the dielectric support 12, and the line bisecting the two antennas (refer to FIG. 1) were vertical. Thus, the "0" line at the left of the graph represents the case where the incoming signal is of a linear polarization parallel to the line bisecting the two antennas In this case both spirals are being illuminated symmetrically, and there will be no phase difference in the signal output from each of the spirals. If the incoming linear wave has a linear polarization of 45° relative to the line bisecting the two spirals, the signals output by each spiral will be out of phase by 90°, as can be seen in the graph. As the polarization angle increases toward 180°, the phase difference increases toward 360°. When the polarization of the incoming signal is at exactly 180°, or effectively "upside-down", there will either be no phase difference between the signals output by each spiral, just as when the signal has a polarization angle of 0°, or a difference of 360°This ambiguity is shown by the break in the curve at the 180° point. Similarly, polarization angles from 180° to 360° cause phase differences identical to that from 0° to 180°, as is clear from the double curve of FIG. 3. Although there is an ambiguity in the curve, this ambiguity is usually not crucial to practical use of the antenna group.

By further processing the information from an incoming linearly polarized wave, the spiral group can be used in an "interferometer mode". When illuminated by a linearly polarized wave, the two antenna outputs can be fed to an additional amplitude and phase-sensing network to process single-plane (i.e., the plane of the two spirals in the group) angle information from the two antennas operating as a single-plane angle sensing group. That is, the group can be used to locate the direction of the source of an incoming linear wave, relative to the plane of the spiral antennas. The relationship between the phase difference $\Phi_1$ of the waves coming into each of the antennas of the group and the angle $\Theta$ relative to a plane through the radius or diameter separating the two antenna elements receiving the signal is coming is given by the formula $$\Phi_1 = \frac{2\pi d_1}{\lambda} \sin \Theta$$

where $\lambda$ is the wavelength of the incoming linearly polarized wave and $d_1$ is the spacing between the activated portions of each spiral. These phase comparisons and calculations may be done by detection techniques and equipment known in the art.

If the two spirals in the group are arranged to have the same configuration sense, the group can be used as a "bidextrous" antenna group. This geometry allows the interferometer mode to be operative for an incoming circular polarized wave of the same sense as the antennas. By contrast, when the ambidextrous group is illuminated by a circular polarized wave, one of the ambidextrous antennas would be cross-polarized and the interferometer would not be operative.

It has been found that, with the antenna structure of the present invention, both the polarization and interferometer modes can now be used simultaneously if desired, along with the dual circular polarized modes of the individual deformed apertures. Previous geometries did not allow for all of these options simultaneously.

With a spiral group having two antennas or apertures, the direction of an incoming linear signal can be determined along an azimuthal plane. The spiral group in its interferometer mode can determine only the compass direction from which the incoming signal is being emitted. However, by using a group with four apertures, that is, two pairs of spiral antennas with opposite configuration senses, angle information about an incoming linearly polarized wave can be obtained for two perpendicular planes. With a four spiral group, the antenna group can locate the source of a linearly polarized wave on both the azimuthal plane and an elevational plane above and below the plane of the antenna.

Figure 4:
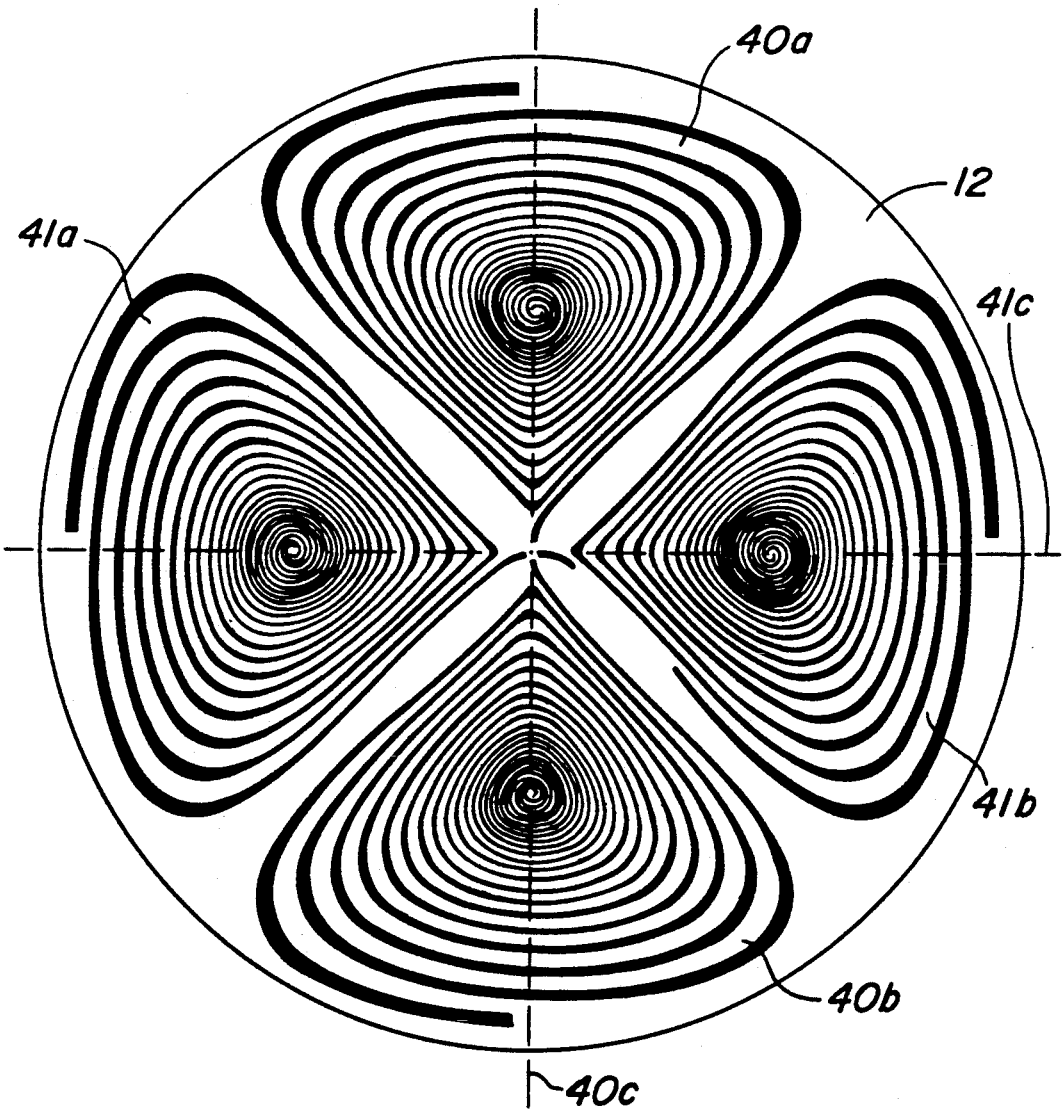
FIG. 4 is a plan view of a spiral antenna group having four deformed spiral antennas.
Figure 5:
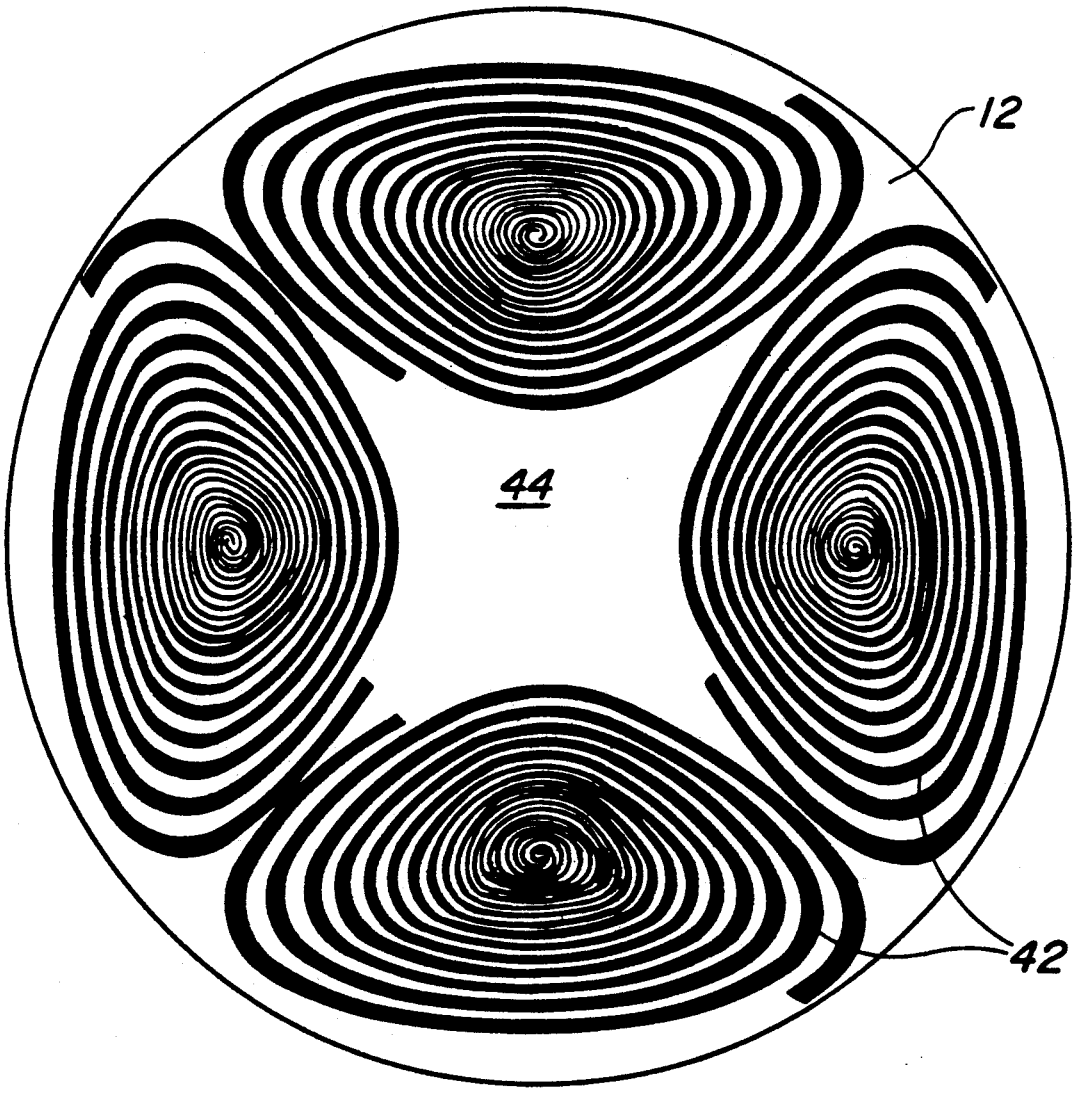
FIG. 5 is a plan view of an antenna group having four Archimedean-logarithmic based deformed spiral antennas, further having a central open area between the antennas.
Figure 6A:
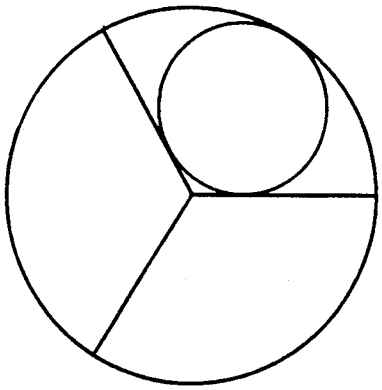
FIGS. 6A-6F are a series of schematic diagrams showing the arrangements of different numbers of spiral antennas on a circular group.
Figure 6B:
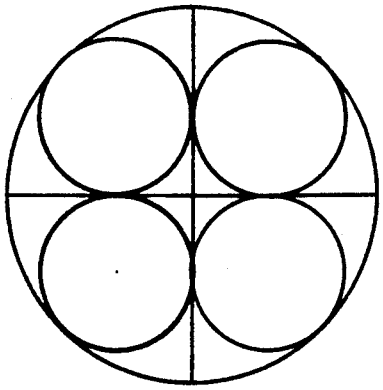
Figure 6C:
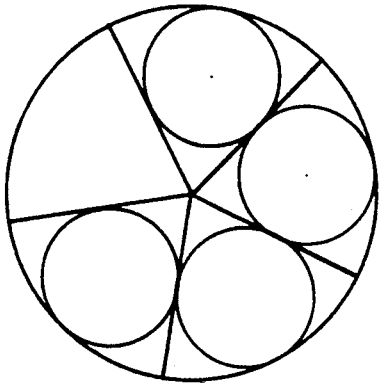
Figure 6D:
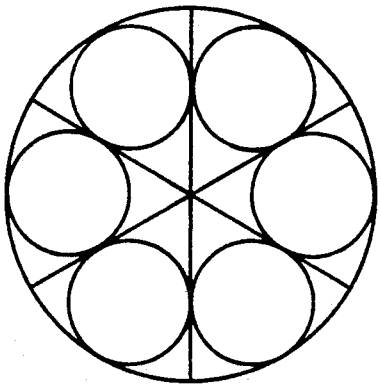
Figure 6E:
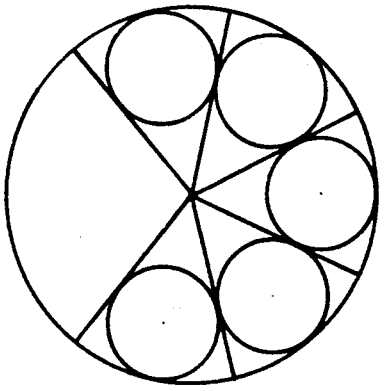
Figure 6F:
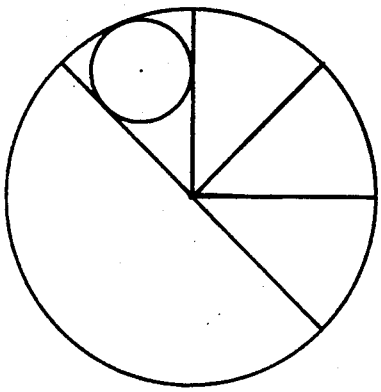

FIGS. 4 and 5 show two possible configurations of four spiral antennas arranged on the surface of a dielectric plate in a manner according to the present invention. With four antennas, arranged in two pairs disposed diametrically opposite each other on the surface of the dielectric plate, the polarimeter and interferometer modes can be used for each diametrically-opposed pair of spiral antennas for locating signal sources in two planes about the antenna.

In FIG. 4 is shown an arrangement of four deformed-spiral antennas arranged in diametrically-opposed pairs 40*a*, 40*b*, 41*a*, 41*b*. Diameter 40*c* runs through the centers of deformed spirals 40*a* and 40*b*, and orthogonal diameter 41*c* runs through the centers of deformed spirals 41*a* and 41*b*. When surface 12 is arranged vertically with respect to the ground, planes 40*c* and 41*c* respectively represent vertical (elevational) and horizontal (azimuthal) planes upon which the two spiral antenna pairs 40*a*, 40*b* and 41*a*, 41*b* can locate sources of linearly-polarized waves. The deformed spiral antennas of each pair have opposite configuration senses, and function exactly like those of the two-antenna group described above. In the two-antenna group of FIG. 1, the single pair of antennas are able to locate the source of an incoming linearly-polarized wave only in two dimensions, along a plane which passes through the centers of the two spirals. With four antennas, as in FIG. 4, each pair of antennas may locate a source of a linearly-polarized wave along a plane through the centers of its spirals, thus allowing the four-antenna group to locate a source in azimuthal and elevational planes. Upper and lower spirals 40*a* and 40*b* are able to locate the source along a vertical plane defined by diameter 40*c*, and side spirals 41*a* and 41*b* are able to locate the source through the horizontal plane defined by diameter line 41*c*.

As in the two-antenna case above, the angle of the source along the plane is related to the phase difference between the signals received by the spiral antenna in each pair. In each principal plane (AZ or EL) the angle is related to the phase difference by the formulas:

$$\Phi_1 = \frac{2\pi d_1}{\lambda} \sin \Theta_{AZ}$$

$$\Phi_2 = \frac{2\pi d_2}{\lambda} \sin \Theta_{EL}$$

Where $\Theta_{AZ}$ is the angle of the source of the linearly polarized wave along the azimuthal plane, and $\Theta_{EL}$ the angle of the source along the elevational plane. $\Phi_1$ is the phase difference detected between antennas 41*a* and 41*b*, and $\Phi_2$ is the phase difference detected between 40*a* and 40*b*. The calculated angles are fed into a central processing means known in the art and then the source is located in two dimensions (azimuth and elevation).

FIG. 5 shows a slightly different embodiment of a four-antenna group. In FIG. 4, the spirals 40 and 41 are shaped to approximate the profile of an entire quarter of a circle. In FIG. 5, the spirals 42 are arranged to allow room for a central open area 44 for other equipment, such as a millimeter waves or IR sensor. In either case, diametrically opposite spirals are wound in opposite configuration senses, although for other purposes these spirals need not be arranged in different configuration senses. This four-aperture system is useful in applications such as a polarimetric radar warning receiver, a high direction-finding-accuracy radar warning receiver, a two-plane angle and polarization sensing antenna, or a polarimetric RF seeker head.

For various specific tasks, any number of antennas may be included on a single circular plate in the deformed-spiral fashion of the invention. FIGS. 6 *a–f* show arrangements of different numbers of antennas as they may be disposed on the circular surface 12. A plurality of antennas may be arranged in a symmetrical fashion about diameters of the surface so as to aid in detecting the location of linearly polarized signals, or otherwise disposed on the plate as required in a given situation. The antennas may be arranged in pairs having opposite configuration senses. However, it is not necessary to the invention that all of the sectors of the support surface 12 be occupied by an antenna, that all of the sectors be the same size, or that all sectors be co-planar.

The advantage of the deformed-spiral structure is that, by distorting the spiral windings to occupy a maximum of each sector of the plate, an optimization can be made between the number of antennas that can be placed on a given space and the longest possible wavelength to which the outermost winding of each spiral antenna is sensitive.

Figure 7:
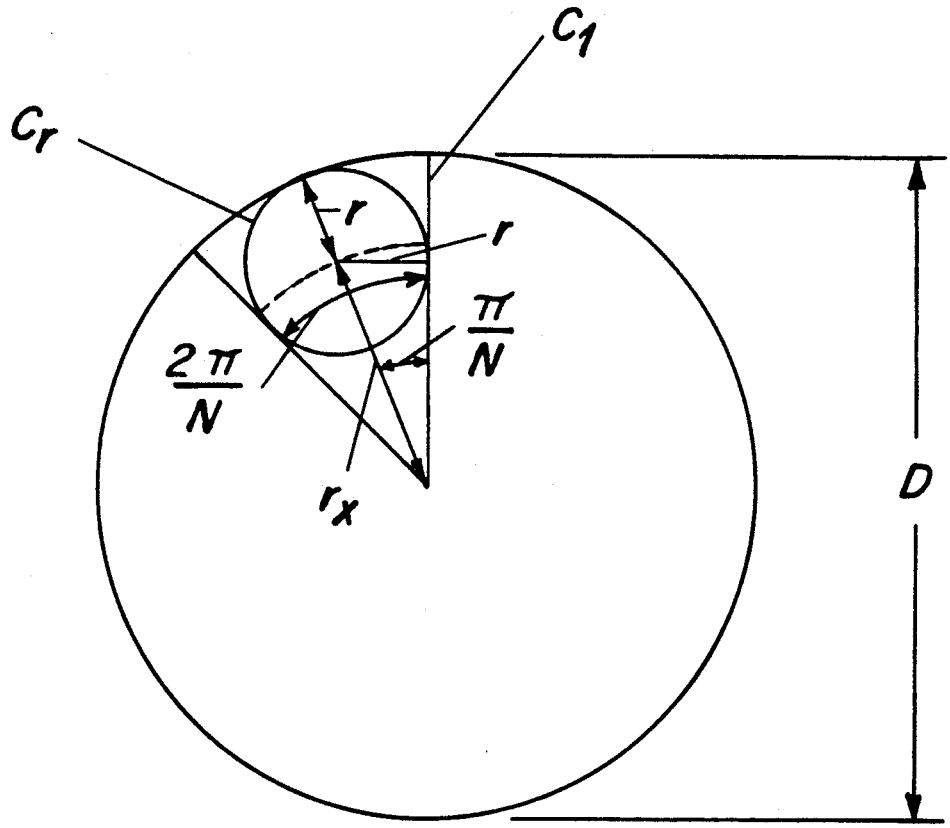
FIG. 7 is a schematic diagram showing the relationships of various dimensions relating to the geometry of the spiral antennas in the group.

The extent of this optimization is shown in FIG. 6 for the general case of locating N antennas radially symmetrically around the center of a circular plate with a diameter D. Within each sector of the main circle, the largest perfect circle that can fit without distorting the outermost arms is shown in FIG. 7 as a small circle with radius r. Through trigonometric analysis, the circumference $C_r$ of this circle can be derived as $$C_r = \pi D \frac{\sin[\pi/N]}{1 + \sin[\pi/N]}$$

The maximum possible perimeter of the sector, which is equal to the theoretical maximum of the longest wavelength to which the spiral antenna is sensitive, is shown in bold lines in FIG. 7 as $C_1$. For a circle of diameter D divided into N equal sectors the maximum circumference $C_1$ can be derived as $$C_1 = D[1 + (\pi/N)]$$

$C_r$ and $C_1$ represent the respective theoretical minimum and maximum of the longest wavelength that can be accommodated by an antenna located in each sector. The optimization of space on the surface within each sector can be appreciated by considering the ratio of $C_1/C_r$ for various values of N. The greater this ratio, the more inefficient a simple circular spiral antenna would be when grouped symmetrically about the center of the circular disk. The theoretical maximum efficiency for each antenna in a group of N antennas is the ratio $C_1/C$, where C is the circumference of the outer circle. As mentioned above, with a two-aperture group (N =2) the theoretical maximum wavelength that can be detected by a deformed spiral making maximum use of the half-circle is 0.8183 times the circumference of the whole circle. Thus, the maximum wavelength that can be detected by such a group is 0.8183 that of a single spiral antenna occupying the same space within cavity 13. With higher values of N, the values of $C_l/C$ become lower, but they will invariably be significantly greater than that of N number of undeformed spirals. The following table shows comparative values of $C_l/C_r$ and $C_l/C$ for varying values of N:

| N | $\frac{C_1}{C_r}$ | $\frac{C_1}{C}$ |
|---|---|---|
| 2 | 1.6367 | 0.8183 |
| 3 | 1.4041 | 0.6516 |
| 4 | 1.3720 | 0.5683 |
| 8 | 1.6018 | 0.4433 |
| 16 | 2.3327 | 0.3808 |

Figure 8:
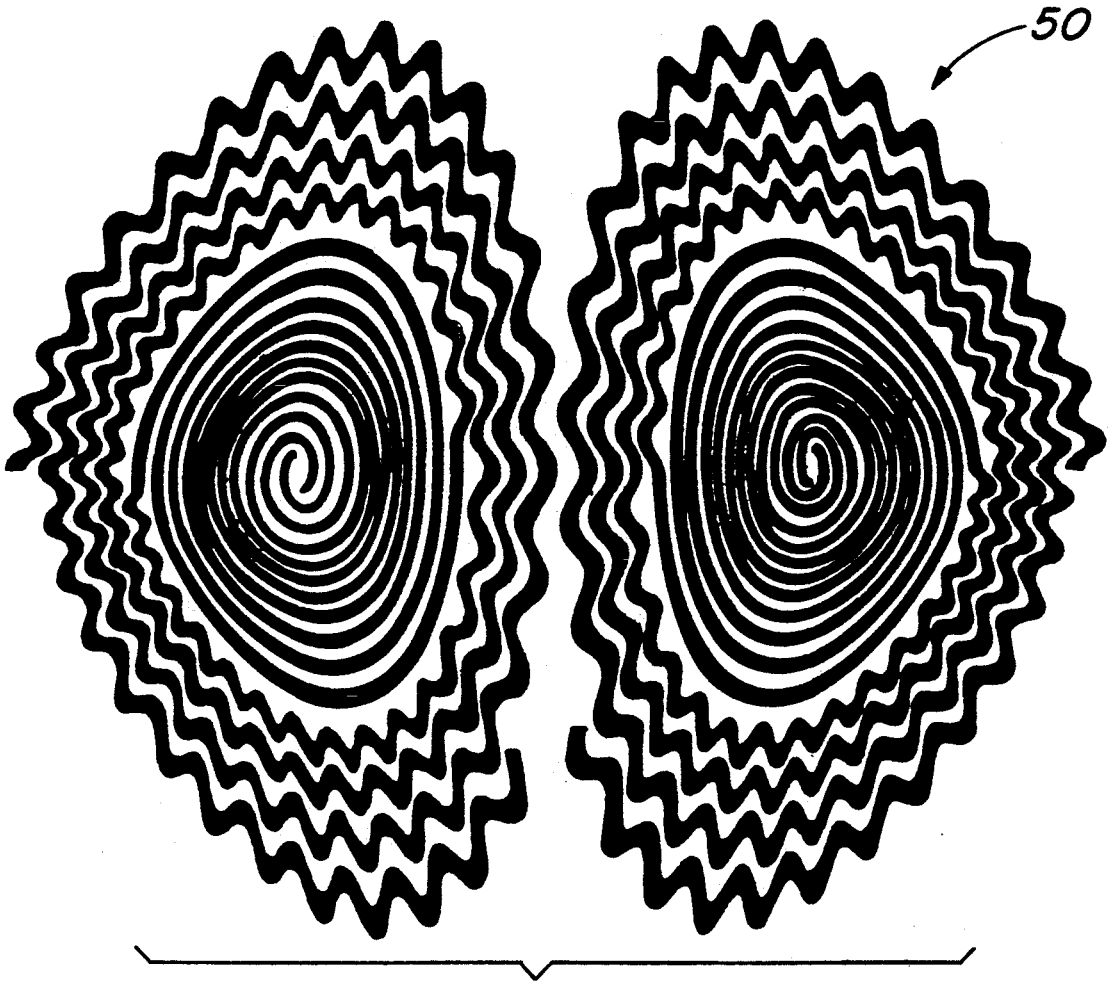
FIG. 8 is a plan view of a spiral antenna according to another embodiment of the present invention, in which the outer periphery of the spirals are in a zig-zag configuration.

Within the scope of the claims there are other techniques for increasing the maximum possible wavelength for a spiral antenna in a given situation. FIG. 8 shows an arrangement of two spiral antennas, each occupying a semi-circular area. In this embodiment, the outer arms of each spiral antenna are arranged in a zig-zag arrangement, as shown. The zig-zag enables the spirals to be packed into each semi-circular area more efficiently, and provides a greater effective length of the outer most spiral.

Another variation of antenna group structure within the scope of the claims is shown in FIGS. 9 *a–c*. These figures show various views and arrangements of deformed-spiral antennas disposed on different planes, rather than all of the antennas being co-planar. Any number of spiral antennas may be disposed in any arrangement on a tilted plane 54 so as to increase the available surface area within a cylindrical volume of a certain diameter. Of course, when using a tilted-plane arrangement in conjunction with ranging or locating equipment, the relative angles of the titled plane must be taken into account in the associated computing system.

The present invention may be embodied in other specific forms without departing from the spirit or essential attributes thereof and, accordingly, reference should be made to the appended claims, rather than to the foregoing specifications, as indicating the scope of the invention.

We claim:

1. An antenna group occupying a substantially circular area, comprising a plurality of spiral antenna disposed adjacent one another, radially symmetrically arranged about the centerpoint of the circular area, each spiral antenna comprising a pair of windings arranged in a spaced, interleaved configuration, each winding having a feed point at a first end of the spiral antenna, each spiral antenna being symmetrically deformed to occupy the area within a sector of the circular area such that the length of each winding of each antenna measured from a second end of the spiral antenna remote from the feed points in a direction along said winding from said second end toward said first end to the point where the winding first intersects a radius extending from said second end to a midpoint between each windings feed points is not less than 0.75 times the circumference of the circular area, the windings being arranged to yield a stable phase center located at said midpoint, wherein the windings of at lest one of the spiral antennas are generally Archimedean spirals in the vicinity of the feed points of the spiral antenna and generally logarithmic sprials in the vicinity of said second end of the spiral antenna.

2. An antenna group as in claim 1, wherein all the antennas are disposed co-planar with one another.

3. An antenna group as n claim 1, wherein the spiral antennas are of opposite configuration senses.

4. An antenna group as in claim 1, wherein all of the spiral antennas have the same configuration sense.

5. An antenna group as in claim 1, wherein one of the spiral antennas is an Archimedean spiral.

6. An antenna group as in claim 1, wherein one of the spiral antennas is a logarithmic spiral.

7. An antenna group as in claim 1, wherein at least a portion of at least one of the spiral antennas has a zigzag configuration.

8. An antenna group having two separate symmetrically deformed spiral antennas, each spiral antenna comprising a pair of windings arranged in a spaced, interleaved configuration, each winding having a feed point at a first end of the spiral antenna, the windings of each antenna being arranged to yield a stable phase center located at a midpoint between each winding's feed point, said antennas being disposed adjacent and co-planar with one another within a circular area, each spiral antenna being symmetrically deformed to occupy the area within a sector of the circular area such that the length of each winding of each antenna measured from a second end of the spiral antenna remote from the feed point in a direction along said winding from said second end toward said first end to the point where the winding first intersects a radius extending from said seconded to said midpoint is not less than 0.75 times the circumference of the circular area, wherein the windings of at least one of the spiral antennas are generally Archimedean spirals in the vicinity of the feed points of the spiral antenna and logarithmic spirals in the vicinity of a second end of the spiral antenna remote from the feed points.

9. An antenna group as in claim 8, wherein the two spiral antennas have opposite configuration senses.

10. An antenna group as in claim 8, wherein the two spiral antennas have the same configuration sense.

11. An antenna group as in claim 8, wherein each antenna occupies about half the area defined by the circular area.

12. An antenna group as in claim 8, wherein the two spiral antennas are mounted on a planar support.

13. An antenna group as in claim 12, further comprising a third antenna disposed on the planar support.

14. An antenna group as in claim 8, wherein one of the spiral antennas is an Archimedean spiral.

15. An antenna group as in claim 8, wherein one of the spiral antennas is a logarithmic spiral.

16. An antenna group occupying a substantially circular area, comprising a plurality of spiral antennas disposed adjacent to one another, radially symmetrically arranged abut the center point of the circular area, each spiral antenna comprising a pair of windings arranged in a spaced, interleaved configuration, each winding having a feed point at a first end of the spiral antenna, each spiral antenna being symmetrically deformed to occupy the area within a sector of the circular area such that the length of each winding of each antenna measured from a second end of the spiral antenna remote from the feed point in a direction along said winding from said second end toward said first end to the point where the winding first intersects a radius extending from said second end to a midpoint between each winding's feed points is not less than 0.75 times the circumference of the circular area, at least one of the spiral antennas being a generally Archimedean spiral in the vicinity of the feed points of the spiral antenna and a generally logarithmic spiral in the vicinity of a second end of the spiral antenna remote from the feed points, said pair of windings of each antenna being arranged to yield a stable phase center located at said midpoint.

17. An antenna group having two separate symmetrically deformed spiral antennas, each spiral antenna comprising a pair of windings arranged in a spaced, interleaved configuration, each winding having a feed point at a first end of the spiral antenna, the windings of each antenna being arranged to yield a stable phase center located at a midpoint between each winding's feed point, said antennas being disposed within a circular outline, one of the antennas being disposed in a plane different from the plane of the other antenna, each spiral antenna being symmetrically deformed to occupy the area within a sector of the circular area such that the length of each winding of each antenna measured from a second end of the spiral antenna remote from the feed points in a direction along said winding from said second end toward said first end to the point where the winding first intersects a radius extending from said second end to said midpoint is not less than 0.75 times the circumference of the circular area, wherein the windings of at least one of the spiral antennas are generally Archimedean spirals in the vicinity of the feed points of the spiral antenna and logarithmic spirals in the vicinity of a second end of the spiral antenna remote from the feed points.

* * * * *